US007128584B2

(12) United States Patent
Gazelot

(10) Patent No.: US 7,128,584 B2
(45) Date of Patent: Oct. 31, 2006

(54) MODULAR FILTERED ELECTRICAL CONNECTOR HAVING REMOVABLE INSERT

(75) Inventor: Yves Gazelot, Brie Comte Robert (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 11/001,878

(22) Filed: Dec. 2, 2004

(65) Prior Publication Data

US 2005/0164557 A1 Jul. 28, 2005

(30) Foreign Application Priority Data

Dec. 4, 2003 (FR) ..... 03 14233

(51) Int. Cl.
*H01R 13/648* (2006.01)

(52) U.S. Cl. ..... 439/95

(58) Field of Classification Search ..... 439/95, 439/362, 276, 359, 355, 587
See application file for complete search history.

(56) References Cited

U.S. PATENT DOCUMENTS 3,961,294 A * 6/1976 Hollyday ..... 333/182
4,376,922 A * 3/1983 Muzslay ..... 333/182
4,500,159 A * 2/1985 Briones et al. ..... 439/607
4,699,590 A * 10/1987 Farrar et al. ..... 439/95
4,729,743 A 3/1988 Farrar et al. ..... 439/276
4,786,260 A * 11/1988 Spaulding ..... 439/607
4,795,372 A * 1/1989 Kobler ..... 439/607
5,219,296 A * 6/1993 Nguyen ..... 439/95
5,236,376 A 8/1993 Cohen ..... 439/620
5,647,766 A 7/1997 Nguyen ..... 439/620
6,478,626 B1 * 11/2002 Dingenotto et al. ..... 439/620

* cited by examiner

*Primary Examiner*—Chandrika Prasad
(74) *Attorney, Agent, or Firm*—Perman & Green, LLP

(57) ABSTRACT

A modular filtered electrical connector more particularly intended for the protection of electronic equipment against excess voltage, including a metal housing 1 with at least one cavity 3 destined to receive an insert 12 consisting of an insulating body equipped with contacts and filtration elements, including a peripheral frame 15 of dimensions larger than the internal peripheral dimensions of cavity 3 and provided with fixing holes 16 and a clamping device 17.

11 Claims, 3 Drawing Sheets

MODULAR FILTERED ELECTRICAL CONNECTOR HAVING REMOVABLE INSERT

CROSS REFERENCE TO RELATED APPLICATIONS

This application claims priority from French Patent Application No. 0314233 filed on Dec. 4, 2003.

BACKGROUND OF THE INVENTION

1. Field of the Invention

The present invention concerns a modular filtered electrical connector, more particularly intended for the protection of electronic equipment against excess voltages generated by electromagnetic interference or electrostatic discharges.

2. Brief Description of Related Developments

Protection against these phenomena has formed the subject of numerous studies about the use of filters integrated into the connectors, which are employed both in industrial sites and in instruments carried on board aircraft or of space vehicles.

All solutions studied have nevertheless in common the observance of international standards on the level of complementing a male or female connector, belonging to the same series, a function called the ability to intermarry and that of being able to be interchanged with standard connectors belonging to the same series.

In order to satisfy these two criteria, it has been proposed to use an adapter to convert existing items of equipment, without modifying them.

It is in this way that U.S. Pat. No. 3,961,294 describes the adaptation of a conventional connector by means of a ferrule connected to the back portion of the connector. This electrically conducting ferrule comprises a dividing plate linked to the internal wall of the ferrule and is provided with holes which receive contacts fitted or otherwise with filtration elements. The filtration element housings are soldered to the dividing plate. The ferrule comprises a shoulder, which rests on the flange of the housing, a flange to which it is soldered, thus providing electrical continuity for receiving the ground of the filtration elements. It is evident that such an arrangement necessitates a large amount of space inside the cabinet or the rack, where the connector housing is fixed and makes impossible any replacement of such an adapter as the result of the soldered link.

U.S. Pat. No. 4,729,743 describes a filtered connector, which satisfies the criteria of the ability to be interchanged, whilst providing the functions of filtration and suppression of transients. The components are grouped in a single insert introduced into the central cavity of the connector housing and a ground contact is connected to the housing by soldering or using a conducting epoxy resin. The insert is finally held in place with an insulating potting between sealing discs.

U.S. Pat. No. 5,236,376 describes an insert, which provides electronic protection to a connector against transients. The insert consists of an assembly of printed circuits carrying the filtration elements and the contacts. The insert is connected to the connector housing, in order to provide electrical continuity between these elements and is held in place, according to one embodiment, by insulators placed in front and behind the insert.

These solutions are not however satisfactory, because they do not make possible either the disassembly or the replacement of the inserts and they moreover tolerate only with great difficulty constraints necessitated by the observance of maximum dimensions imposed by users.

The use of rectangular or circular inserts, which after being inserted into the cavities of a housing or a receptacle connector, are fixed into the cavities by a flange held in place by screws working in conjunction with threaded holes made in the back face of the bottom of the housing or the receptacle connector, is moreover known in the prior art.

Lastly, the current technology of filtered connectors proposes elements fixed in the housing, which compels the user of cabinets or racks to modify his equipment extensively, when he wishes either to improve by increasing the number of functions, or to carry out a retrofit ting of the said equipment, or simply when a maintenance operation necessitates the replacement of a part of the connector.

There is therefore a need to provide housings or standard receptacle connectors thanks to which a user can at the design stage choose a connector, which will make possible the modularity or filtration inserts, which can be replaced or installed during the life of operation of equipment incorporating such a connector.

SUMMARY OF THE INVENTION

This is why the present invention has the object of making possible the disassembly and the replacement of inserts integrated into a connector constituting elements of protection of electronic equipment, in order to design modular filtered electrical connectors.

With that object in view, the present invention proposes a modular filtered electrical connector more particularly intended for the protection of electronic components against excess voltage, comprising a metal housing equipped with at least one cavity, destined to receive an insert consisting of a insulating body fitted with contacts and filtration elements, the said insert comprising a peripheral frame of dimensions larger than the internal peripheral dimensions of the cavity.

According to one of the principal characteristics of the invention, the frame is provided with fixing holes, which enable the insert after their introduction into the cavity, to be fixed on the housing by means of a clamping device passing over the holes of the frame, in order to provide the movable fixing of the insert on the housing.

According to one of the variants of the invention, the clamping device takes the form of at least one screw with an elastic washer, whose threaded barrel engages with the thread made in the holes of the housing.

According to one of the principal embodiments of the invention, at least one of the holes of the housing is fitted with a distance sleeve, which provides the positioning of the insert in the cavity which its equips, the length of the said distance sleeve being a function of the thickness of the peripheral frame of the insert.

According to this embodiment, the distance sleeve comprises at one its ends an outside thread and is at its other ends a hollow bush, provided with an internal thread, each distance sleeve being fixed in one of the holes of the housing by the screwing of the outside thread of the distance sleeve into the thread made in the hole of the housing.

According to this embodiment, after its introduction into the cavity, the insert is fixed on the housing by means of clamping devices passing over the holes of the frame and engaging in the threaded bushes of the distance sleeves, thus providing the movable fixing of the insert on the housing.

According to one of the principal characteristics of the invention, at least one of the fixing holes in the frame of the insert is fitted with a ground element, providing electrical continuity between the frame and the housing.

According to a preferred embodiment, at least one of the fixing holes of the frame of the insert is provided on its internal surface with a groove, whilst a ground connection clip fits by an extension into the circular groove.

According to the invention, the modular filtered electrical connector is equipped with movable inserts, in order to make possible their replacement during an operation of maintenance, adaptation or retrofitting.

BRIEF DESCRIPTION OF THE DRAWINGS

The invention will be more easily understood with the help of the following description and the attached drawings in which

FIGS. 3*a* and 3*b* represent a sectional view of a portion of the inserts of FIG. 3.

DETAILED DESCRIPTION OF THE PREFERRED EMBODIMENT(s)

A standard rectangular connector of the ARINC type is represented in FIG. 1, but it is evident that the invention can be applied to any circular connector comprising a housing or a receptacle connector for equipping cabinets, racks or panels.

Figure 1A:
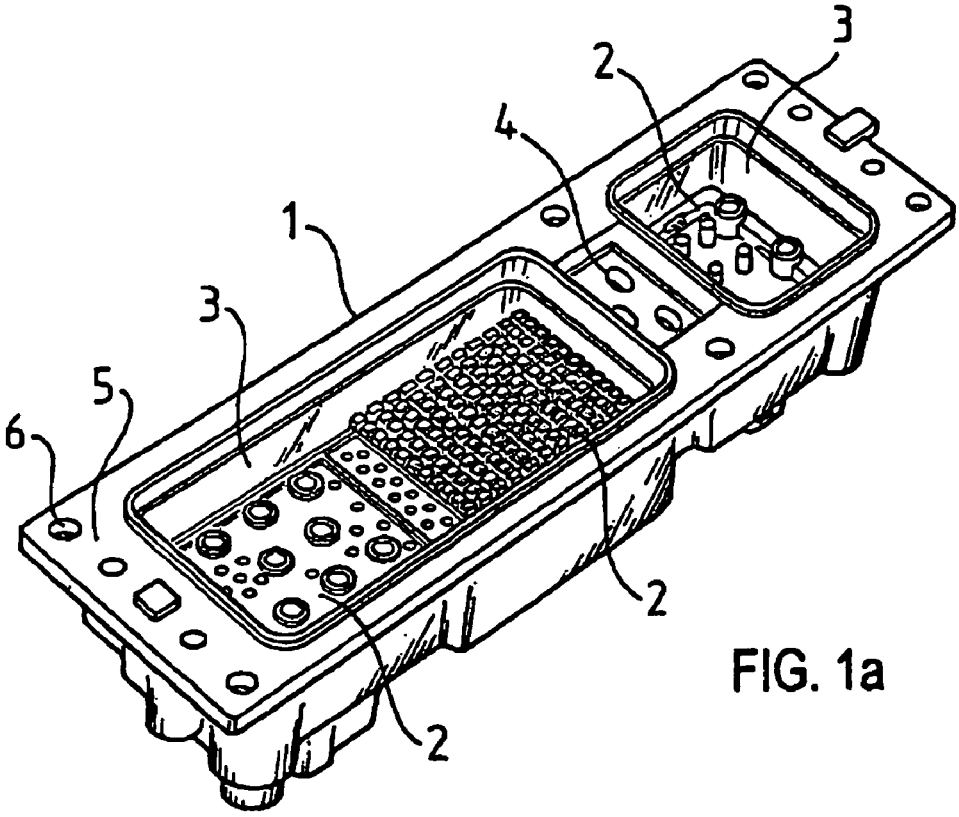
FIGS. 1*a* and 1*b* represent respectively a plan view and a view from below of a conventional connector of the prior art.

FIG. 1*a* is a plan view of a metal housing 1 comprising insulators 2 fitted with contacts of different types arranged in the insulator according to arrangements offered in the catalogue by the manufacturer or according to criteria of design specified by the user. The housing, which is generally obtained by injection moulding, has two cavities 3, in which are inserted the insulators 2. A central cavity 4 makes possible the insertion of polarisation keys, needed for mating of a supplementary connector. A flange 5 comprises holes 6 which make possible the fixing of the housing on the panels, which equip the racks or cabinets.

Figure 1B:
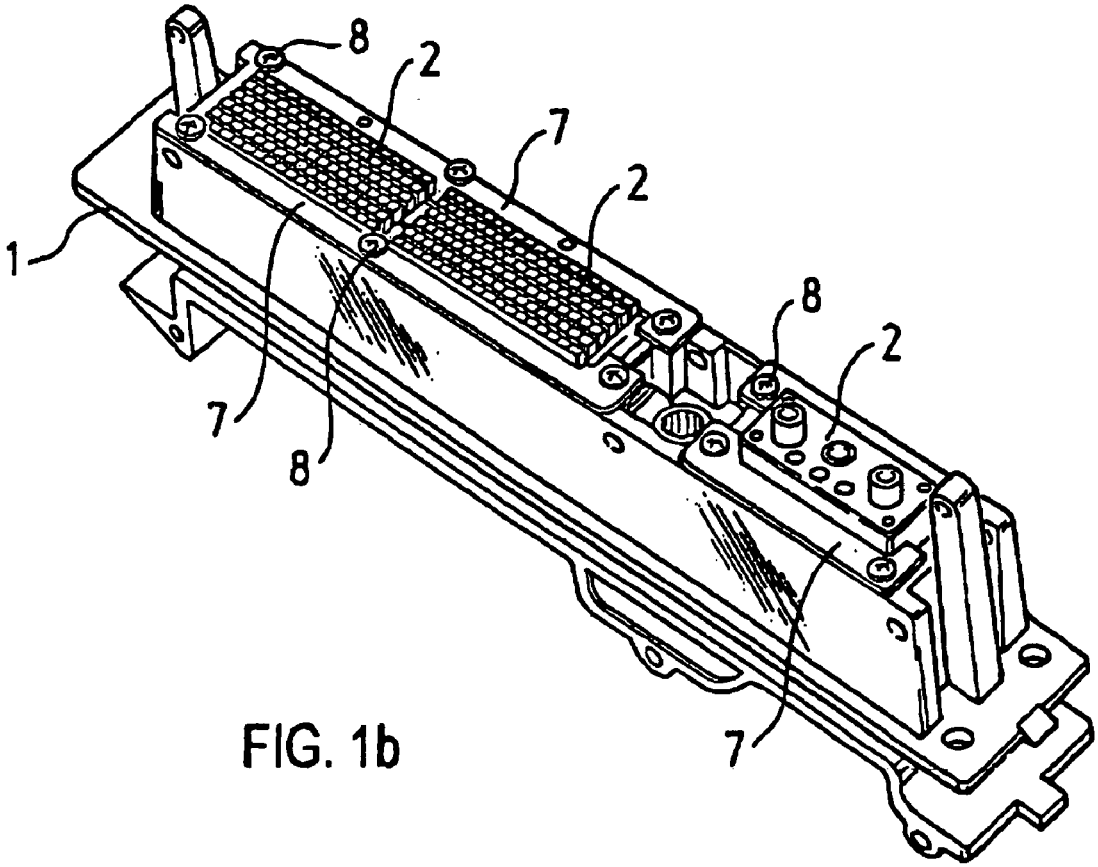
Figure 2:
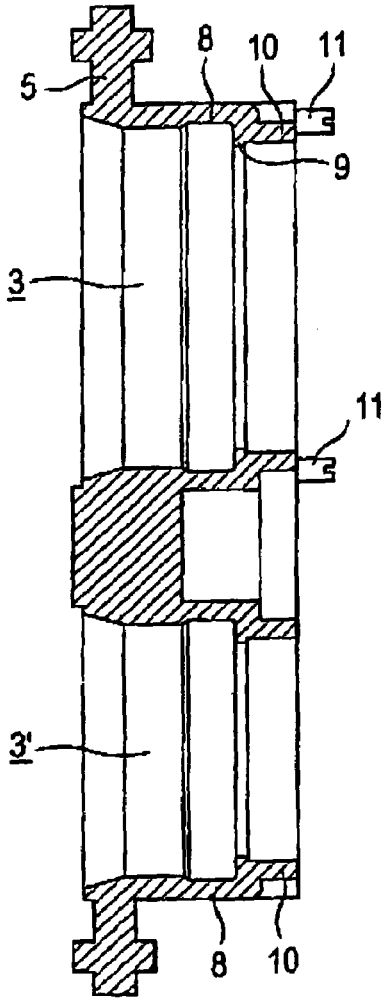
FIG. 2 represents a section of a connector housing according to the present invention.
Figure 4:
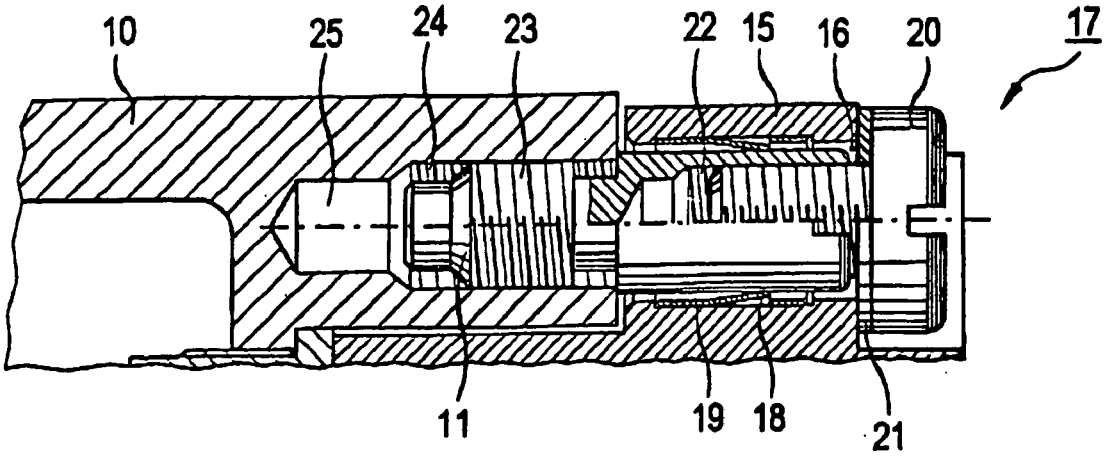
FIG. 4 represents a section of the fixing device of the insert support frame according to a first embodiment.

FIG. 1*b* is a view from below of the housing from FIG. 1*a* and shows in detail the device for retaining the insulators 2 in the cavities. After insertion through the bottom of the cavity, the insulators come to be supported by internal shoulders 9, as can be seen in FIG. 2 and are wedged on these shoulders by half-flanges 7, which are fixed to the bottom of the housing by screws 20 engaging in the threaded holes 25 in the walls of the cavity, as can be seen in FIG. 4. This arrangement makes it possible to fix the insulators 2, whose contacts are wired to conductors or coupled to a plate arranged parallel to the wall on which the housing is fixed.

FIG. 2 represents a section of a housing according to the invention. This housing is of standard manufacture. It can nevertheless undergo slight modifications of the depth of cavities 3 and 3' whose ends 10 of walls 8 can be machined as to length so as to compensate for the space requirement of an insert support as will be described below. The walls 8 comprise a shoulder 9, which serves as a depth stop and wedge when components are inserted into the cavities through the back. On the bottom of the housing are arranged distance sleeves 11, which are screwed into the threaded holes 25 made in the thickness of the wall 8 on the level of the end part 10. It will be noted that the cavity 3' does not have distance sleeves 11.

Figure 3:
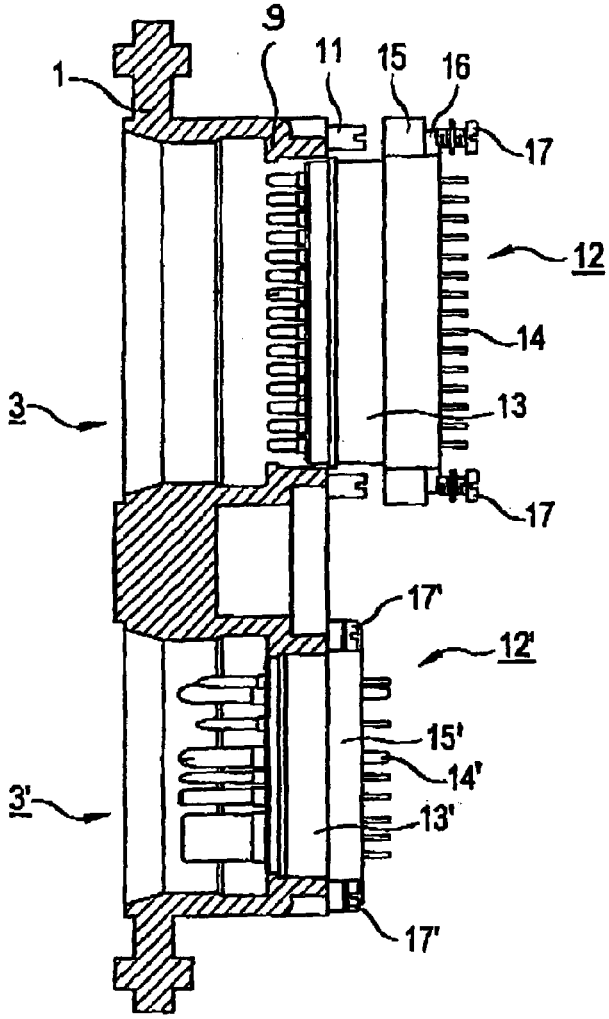
FIG. 3 represents a housing according to FIG. 2 equipped with inserts.

FIG. 3 represents a housing 1 partially equipped with modular inserts 12, 12' according to the present invention. These inserts provide the electronic protection of the connector against transients. In fact, in order to avoid any excess voltage due to electrostatic discharges, electromagnetic pulses or any electromagnetic or radio frequency interference, which might involve a bad functioning of the electronic components, which are to be protected, the housing 1 is equipped with inserts 12 and 12' which are positioned perfectly in the cavities 3 and 3'.

Figure 3A:
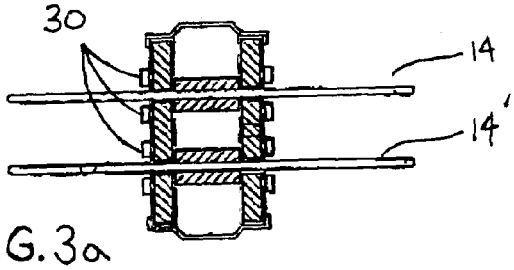

The inserts 12 and 12' consist of an assembly 13, 13' carrying the filtration elements 30 (as can be seen in FIGS. 3*a* and 3*b*, which represent a sectional view of the assembly 13, 13' respectively), the contacts 14, 14' as well as an insert supporting frame 15, 15', which constitutes an individual peripheral insert holding structure. This structure defines a flange having a peripheral dimension D2, D2', which makes it possible for the frame 15, 15' to have a perimeter of dimensions D2, D2' greater than those of the internal peripheral dimensions D1, D1' of the cavities 3, 3'. The cavities 3, 3' are able to receive the inserts 12, 12' whose perimeter D3, D3' is slightly smaller than the perimeter D1, D1' of the cavities.

Inside this assembly 13, 13' the elements of filtration 30 are filters of the capacitor type, or diodes in the form of chips or conventional filters of the Pi type, or any combination of these, such as to define the high-density circuits, able simultaneously to effect the filtration and the suppression of transients. All these circuits comprise a ground in the form of individual contacts, which are electrically connected to frame 15, 15' thus providing electrical continuity between inserts 12 and 12' and their respective frames.

The frame 15 comprises a series of fixing holes 16 distributed on its periphery and corresponding to existing threaded holes 25 made in the thickness of the end portions 10 of the cavity walls 8.

The said fixing holes 16 receive the clamping devices 17 and 17', whose design details will be explained below and which make possible after the introduction of the insert into the cavity, the fixing of the frame and because of this, of the insert to the housing 1, making possible a movable fixing, which in turn makes possible the replacement of the insert and which thus confers an adjustable character on connectors.

As can be seen in FIG. 3, the insert 12 is in process of being inserted into cavity 3. The clamping devices 17 are positioned in the fixing holes 16 and these fixing holes are oriented in such a way as to present themselves to the upright of the distance sleeves 11, previously screwed into the holes 25 of the housing in such a way as to position the insert 12 into the cavity 3. The insert is taken as a stop to the shoulder 9 and the fixing of the insert can then be effected by the screwing of the clamping device 17 into existing holes in the distance sleeves 11, as will be described below.

According to another embodiment shown in the lower part of FIG. 3, the insert 12' consists of an assembly 13, whose thickness does not make necessary a modification of the bottom of the housing and whose frame thickness does not necessitate the use of distance sleeves. In that case, the insert is taken as a stop on the shoulder 9 and the fixing of the insert can then be effected by screwing the clamping device 17' into the existing threaded holes 25 in the housing.

These two embodiments make possible the use of inserts of different thickness with, if necessary for a single operation, a reduction by machining of the length of the ends 10 of the walls 8 of the cavity. This operation makes it possible to admit very thick inserts and frames, whilst retaining the final dimensions which enable the contacts 14 located at the back of the connector to be correctly mated to the plate.

FIG. 4 represents a detailed section of the clamping device 17. It moreover represents one of the principal characteristics of the invention, namely, the ability of the ground of the insert to be electrically connected to the frame and to the body of the housing.

For that purpose, the holes 16 made in the frame 15 comprise an internal circular groove 18 into which is fitted an elastic clip 19. This clip, which is preferably gold-plated to provide very good electrical continuity, is constructed in a familiar manner of two curved elastic lugs, which ensure electrical and mechanical contact of the frame and the distance sleeves 11, arranged in the holes 16.

The clamping device 17 consists of a screw 20 and a washer 21. The screw passes over the hole 16 into which leads the upper part of the distance sleeve 11, which has the form of a hollow bush provided with an internal thread 22. The distance sleeve 11 has at its other end an outside thread 23, which makes possible its fixing by screwing into the thread 24 in the wall of the existing holes 25 of the housing. The distance sleeves are preferably gold-plated and have a support face formed by a sharp edge in such a way as to provide by deformation very good electrical continuity when it is clamped on the ends 10 of the housing walls.

Figure 5:
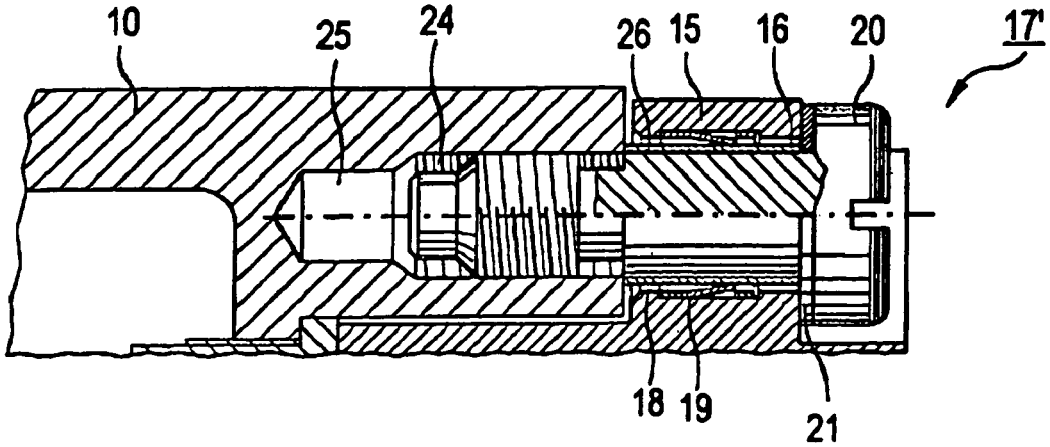
FIG. 5 represents a section of a fixing device of the insert support frame according to a second embodiment.

FIG. 5 represents a detailed section of the clamping device 17' of the insert of a lower thickness 12' shown in FIG. 3. It also represents one of the principal characteristics of the invention, namely the ability of the ground of the insert to be electrically connected to the frame and to the body of the housing.

For that purpose, the holes 16 made in the frame 15 comprise an internal circular groove 18, into which is fitted by an extension an elastic clip 19. The said clip, which is preferably gold plated in order to provide very good electrical continuity is made in a familiar manner of two curved elastic lugs, which provide electrical and mechanical contact of the frame and the screw 20 which passes over the hole 16, either with the help of a metal sleeve 26 arranged between the pitch of the screw 20 and the clip 19, or by means of a smooth part made between the threaded end and the head of the screw.

The clamping device 17' consists of a screw 20 and an elastic washer 21. The screw passes over the hole 16 and penetrates into the thread 24 made in the wall of the existing holes 25 of the housing in such a way as to provide a movable fixing of the insert 12' on the housing 1. The screws 20 are preferably screwed uphold into the ends 10 of the walls of the housing, thus promoting when tightened very good electrical continuity.

The present invention thus makes possible the easy introduction of a filtered insert on the housing of a connector. The fixing devices make possible an equally easy disassembly. For that purpose, the user disconnects the receiving plate of the contacts 14 and then, using the clamping devices 17, uncouples the frame 15 and the housing 1, thus freeing the cavities 3. The said cavities having been freed, the user equips the housing of the connector by fitting inserts of his choice.

The concept of modularity, which covers the present invention, represents the advantage of being able to comply with the needs of customers at the time of the definition of the product by the latter, of being able to provide the maintenance of a deteriorated insert by the user himself, avoiding down time of a piece of equipment or the high cost of replacing a complete connector, the advantage of being able to improve the protection-related performance of electronic equipment by replacing inserts with a limited performance by inserts with improved functions.

The invention is not limited to the particularities of described fixing devices, but embraces all devices, which make possible the disassembly and replacement of filtered movable inserts having devices for the grounding of inserts by the connector housing.

The invention claimed is:

1. A modular filtered electrical connector for the protection of electronic equipment against excess voltage, comprising: a metal housing having threaded fixing holes and at least one cavity having internal peripheral dimensions, the at least one cavity adapted to receive a movable insert consisting of an insulating body with contacts and filtration elements, the movable insert comprising a peripheral frame provided with fixing holes, the peripheral frame being of dimensions larger than the internal peripheral dimensions of the cavity, a clamping device configured to movably fix the insert on the housing after the insert is introduced into the cavity, the clamping device configured to pass over the fixing holes of the frame, wherein at least one of the fixing holes of the housing is equipped with a distance sleeve.

2. A modular filtered electrical connector according to claim 1, wherein the distance sleeve ensures the positioning of the insert in the cavity, which it equips.

3. A modular filtered electrical connector according to claim 1, wherein a length of the distance sleeve is a function of a thickness of the peripheral frame of the insert.

4. A modular filtered electrical connector according to claim 1, wherein the distance sleeve comprises at one of its ends an external thread and at the other end is a hollow bush with an internal thread.

5. A modular filtered electrical connector according to claim 4, wherein each distance sleeve is fixed in one of the fixing holes of the housing by the screwing of the external thread of the distance sleeve into the thread in the fixing hole of the housing.

6. A modular filtered electrical connector according to claim 4, wherein after its introduction into the cavity, the insert is fixed on the housing by means of the clamping device passing over the fixing holes of the frame and engaging in the hollow bush with an internal thread of the distance sleeves, thus providing a moveable fixing of the insert on the housing.

7. A modular filtered electrical connector according to claim 1, wherein at least one of the fixing holes of the frame of the insert is equipped with a ground clip providing electrical continuity between the frame and the housing.

8. A modular filtered electrical connector according to claim 1, wherein at least one of the fixing holes of the frame of the insert is provided on its internal surface with a circular groove.

9. A modular filtered electrical connector according to claim 8, wherein a ground clip is fitted by extension into the circular groove.

10. A modular filtered electrical connector according to claim 1, wherein the inserts are movable in order to make their replacement possible during a maintenance, adaptation or retrofit ting operation.

11. A modular filtered electrical connector according to claim 9, wherein the distance sleeve is configured to be inserted into at least one of the fixing holes of the frame so that the distance sleeve contacts the ground clip to provide an electrical continuity between the housing and the frame of the movable insert.

* * * * *